US011810740B1

(12) United States Patent
Rostron et al.

(10) Patent No.: US 11,810,740 B1
(45) Date of Patent: Nov. 7, 2023

(54) QUICK-SET CLEVIS JOINT FOR A THREE-PHASE ELECTRIC DISCONNECT SWITCH LINKAGE

(71) Applicant: Southern States, LLC, Hampton, GA (US)

(72) Inventors: Joseph R Rostron, Hampton, GA (US); Joseph Andreyo, Hampton, GA (US); Juan Camilo Gill-Gaviria, Hampton, GA (US)

(73) Assignee: SOUTHERN STATES, LLC, Hampton, GA (US)

( * ) Notice: Subject to any disclaimer, the term of this patent is extended or adjusted under 35 U.S.C. 154(b) by 0 days.

(21) Appl. No.: 17/699,210

(22) Filed: Mar. 21, 2022

(51) Int. Cl.
*H01H 33/42* (2006.01)
*H01H 3/30* (2006.01)

(52) U.S. Cl.
CPC ..... *H01H 33/42* (2013.01); *H01H 3/3042* (2013.01); *H01H 2003/3089* (2013.01)

(58) Field of Classification Search
CPC .... H01H 33/42; H01H 3/3089; H01H 3/3042; H01H 2003/3089; H01H 31/003; H01H 31/02; H01H 31/12
USPC ..... 200/48 R, 48 P, 48 A, 48 KB, 48 SB, 200/48 CB, 49; 218/3, 5, 6, 11, 12, 14, 218/45
See application file for complete search history.

(56) References Cited

U.S. PATENT DOCUMENTS 3,339,037 A * 8/1967 Bernatt ..... H01H 33/128 200/48 CB
4,752,859 A * 6/1988 Chabala ..... H01H 33/02 200/48 R
5,091,616 A * 2/1992 Ramos ..... H01H 33/127 200/48 R
5,293,012 A * 3/1994 Levi ..... H01H 31/28 200/275
5,369,234 A * 11/1994 Demissy ..... H01H 33/124 200/48 R
5,821,486 A * 10/1998 Paw ..... H01H 33/022 200/48 R
5,874,900 A * 2/1999 Panto ..... H01H 9/167 200/49
6,678,151 B2 * 1/2004 Costante ..... H02B 5/00 361/603
6,946,607 B2 * 9/2005 Roberts ..... H01H 31/006 200/48 R (Continued)

*Primary Examiner* — William A Bolton
(74) *Attorney, Agent, or Firm* — Mehrman Law Office; Michael J. Mehrman

(57) ABSTRACT

A quick-set clevis joint for a three-phase electric disconnect switch linkage includes a clevis housing having a spring chamber axially aligned and disposed around a linkage pipe extending through the clevis housing. A spring positioned within the spring chamber provides play in the linkage. First and second thrust disks compress the spring in a first axial direction with the first thrust disk pushed against a first spring chamber end wall when the linkage pipe moves in the first axial direction while the clevis housing is blocked from moving in the first axial direction. In addition. the first and second thrust disks compress the spring in the second axial direction with the second thrust disk pushed against the second spring chamber end wall when the linkage pipe moves in the second axial direction while the clevis housing is blocked from moving in the second axial direction.

16 Claims, 7 Drawing Sheets

(56) References Cited

U.S. PATENT DOCUMENTS

| | | | | |
|---|---|---|---|---|
| 7,091,431 | B1 * | 8/2006 | Arcand | H01H 1/42<br>200/48 R |
| 2002/0050484 | A1 * | 5/2002 | Rostron | H01H 33/126<br>218/2 |

* cited by examiner

QUICK-SET CLEVIS JOINT FOR A THREE-PHASE ELECTRIC DISCONNECT SWITCH LINKAGE

TECHNICAL FIELD

The present invention relates to high-voltage electric switchgear and, more particularly, to a quick-set clevis joint for a three-phase electric disconnect switch linkage providing spring-loaded play in the positional calibration of the clevis joint.

BACKGROUND

FIG. 1 (prior art) is a conceptual illustration of a conventional three-phase disconnect switch 10 in the open switch position. FIG. 2 (prior art) shows the switch 10 in the closed switch position. The switch 10 includes three sets of rotating insulators 11*a*1-11*a*2, 11*b*1-11*b*2 and 11*c*1-11*c*2, one set for each electric power phase, Phase-A, Phase-B and Phase-C. The insulators 11*a*1, 11*b*1 and 11*cl* carry a jaws 12*a*, 12*b* and 12*c*, respectively, while the insulators 11*a*2, 11*b*2 and 11*c*2 carry a blade 13*a*, 13*b* and 13*c*, respectively. FIG. 1 shows the disconnect switch 10 in the open switch position, in which the jaws 12*a*, 12*b* and 12*c* are not in electrical contact with their corresponding blades 13*a*, 13*b* and 13*c*. The rotating insulators 11*a*1-11*a*2, 11*b*1-11*b*2 and 11*c*1-11*c*2 are each configured to rotate to bring the jaws 12*a*, 12*b* and 12*c* into electrical contact with their respective blades 13*a*, 13*b* and 13*c*. When the switch 10 is in the fully closed switch position, the blades 13*a*, 13*b* and 13*c* must be properly seated in their respective jaws 12*a*, 12*b* and 12*c* to avoid damaging arcing in the switch connections.

The switch 10 includes a motor-driven or hand-driven actuator, not shown in the figures, for a moving a drive pipe 14 to simultaneously rotate the insulators 11*a*1-11*a*2, 11*b*1-11*b*2 and 11*c*1-11*c*2 to open and close the switch. A conventional linkage 15 connects the drive pipe 14 to the insulators allowing the single drive pipe to rotate all six insulators. The conventional linkage 15 includes a linkage pipe 16 connecting the drive pipe 14 through a series of mechanical connections to phase operating levers 18*a*, 18*b* and 18*c*, one for each electric power phase. The connecting rod 19*a* connects the phase operating lever 18*a* to both rotating insulators 11*a*1-11*c*2 for Phase-A, the connecting rod 19*b* connects the phase operating lever 18*b* both rotating insulators 11*b*1-11*b*2 for Phase-B, and the connecting rod 19*c* connects the phase operating lever 18*c* to both rotating insulators 11*c*1-11*c*2 for Phase-C.

The conventional linkage 15 includes a first clevis joint 17*a* at the junction between the linkage pipe 16 and the phase operating lever 18*a* for Phase-A, a second clevis joint 17*b* at the junction between the linkage pipe 16 and the phase operating lever 18*b* for Phase-B, and a third clevis joint 17*c* at the junction between the linkage pipe 16 and the phase operating lever 18*c* for Phase-C. In this particular example, the conventional linkage 15 also includes a fourth clevis joint 17*d* at the junction between the drive pipe 14 and the phase operating lever 18*b* for Phase-B. In other embodiments, the drive pipe may be connected to Phase-A, Phase-B or Phase-C as a matter of design choice. In addition, in this particular example, the drive pipe 14 is shown to be parallel to the linkage pipe 16. In other embodiments, the drive pipe 14 may be positioned at different angles with respect to the linkage pipe 16 as a matter of design choice.

While the conventional three-phase disconnect switch 10 has served the industry well for decades, it experiences a significant drawback when initially setting up the conventional linkage for the fully closed switch position, which requires precise mechanical calibration. Each of pair of rotating insulators is mechanically fixed to a separate frame, which can result in slight differences in the relative positions of each insulator to the other insulators and to the linkage. The linkage must be calibrated precisely to ensure that each insulator rotates fully so that each blade seats properly within its respective jaws to properly close each phase of the switch. Calibrating the entire linkage is a painstaking process because multiple calibration points have to be manually adjusted. Each linkage pipe typically has its own length adjustment mechanism and changing the length or position of one piece of the linkage can impact the other parts of the linkage. As the relative angles between the linkage pipes and the rotating insulators is critical to the proper operation of the switch, setting the linkage to achieve the correct rotational angles of all six insulators requires multiple measurements and length adjustments. This frequently requires multiple trial-and-error adjustments to achieve the correct calibration. The process has been likened to tuning a piano, where adjustment of each string impacts the notes produced by the other strings.

The electric power industry therefore has a continuing need for improved linkage techniques for three-phase disconnect switches.

SUMMARY

The problem described above is mitigated by a quick-set clevis joint for a three-phase electric disconnect switch linkage including a clevis housing having a spring chamber axially aligned and disposed around a linkage pipe extending through the clevis housing. A support guide is disposed around the linkage pipe, secured to the linkage pipe, and extending through the clevis housing. A spring positioned within the spring chamber allows the support guide and linkage pipe to slide axially with respect to the clevis housing in first and second axial directions.

It will be understood that specific embodiments may include a variety of features in different combinations, and that all of the features described in this disclosure, or any particular set of features, needs to be included in particular embodiments. The specific techniques and structures for implementing particular embodiments of the invention and accomplishing the associated advantages will become apparent from the following detailed description of the embodiments and the appended drawings and claims.

BRIEF DESCRIPTION OF THE FIGURES

The numerous advantages of the invention may be better understood with reference to the accompanying figures in which.

DESCRIPTION OF ILLUSTRATIVE EMBODIMENTS

The problem described above is mitigated by a quick-set clevis joint for a three-phase electric disconnect switch linkage. In a representative embodiment, the quick-set clevis joint includes a clevis housing including a spring chamber, a first channel, and a second channel axially aligned and disposed around a linkage pipe extending through the clevis housing. The spring chamber is bounded in a first axial direction by a first spring chamber end wall at a junction between the spring chamber and the first channel. Similarly, the spring chamber is bounded in a second axial direction by a second spring chamber end wall at a junction between the spring chamber and the second channel. A support guide is disposed around the linkage pipe, secured to the linkage pipe, and extends through the clevis housing. While compression springs are utilized in the specific embodiments described below, tension springs, elastic springs and other suitable types of springs may be utilized as a matter of design choice.

A first retaining ring is captured within the clevis housing, attached to the linkage pipe, sized and positioned to move in the first and second axial directions within the first channel and the spring chamber. Similarly, a second retaining ring is captured within the clevis housing, attached to the linkage pipe, sized and positioned to move in the first and second axial directions within the second channel and the spring chamber. A first thrust disk is captured within the clevis housing, axially movable with respect to the linkage pipe, sized and positioned to move in the first and second axial directions within the spring chamber, while blocked from moving into the first channel by the first spring chamber end wall. Similarly, a second thrust disk is captured within the clevis housing, axially movable with respect to the linkage pipe, sized and positioned to move in the first and second axial directions within the spring chamber, while blocked from moving into the second channel by the second spring chamber end wall.

A spring is positioned within the spring chamber captured between the first and second thrust disks allowing the support guide and linkage pipe to slide axially with respect to the clevis housing in the first and second axial directions. The first and second thrust disks are movable within the spring chamber to compress the spring in the first axial direction with the first thrust disk pushed against the first spring chamber end wall when the linkage pipe moves in the first axial direction while the clevis housing is blocked from moving in the first axial direction. In addition. the first and second thrust disks are movable within the spring chamber to compress the spring in the second axial direction with the second thrust disk pushed against the second spring chamber end wall when the linkage pipe moves in the second axial direction while the clevis housing is blocked from moving in the second axial direction.

Figure 1:
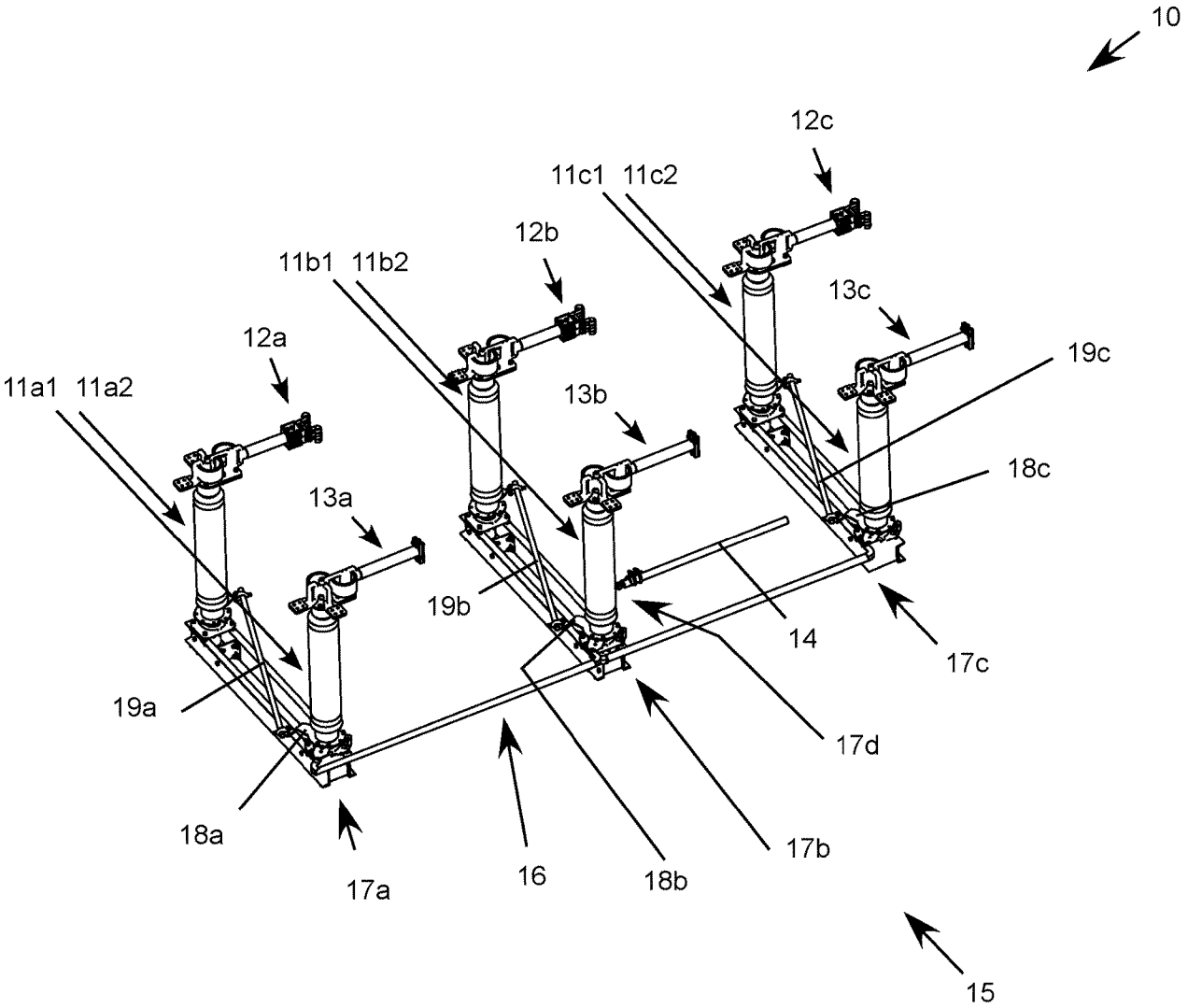
FIG. 1 (Prior Art)
FIG. 1 (prior art) is a conceptual perspective illustration of a conventional three-phase disconnect switch in the open position.
Figure 2:
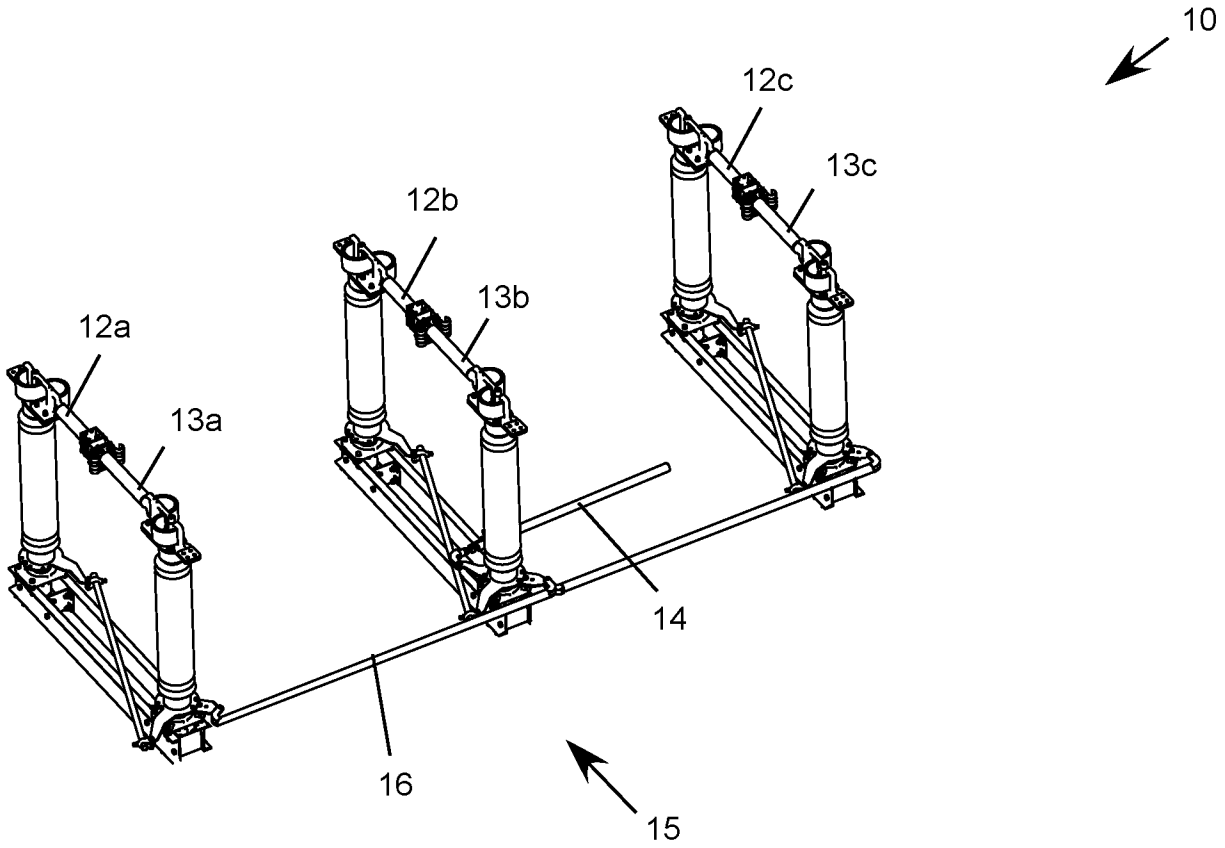
FIG. 2 (Prior Art)
FIG. 2 (prior art) is a conceptual perspective illustration of the conventional three-phase disconnect switch in the closed position.
Figure 3A:
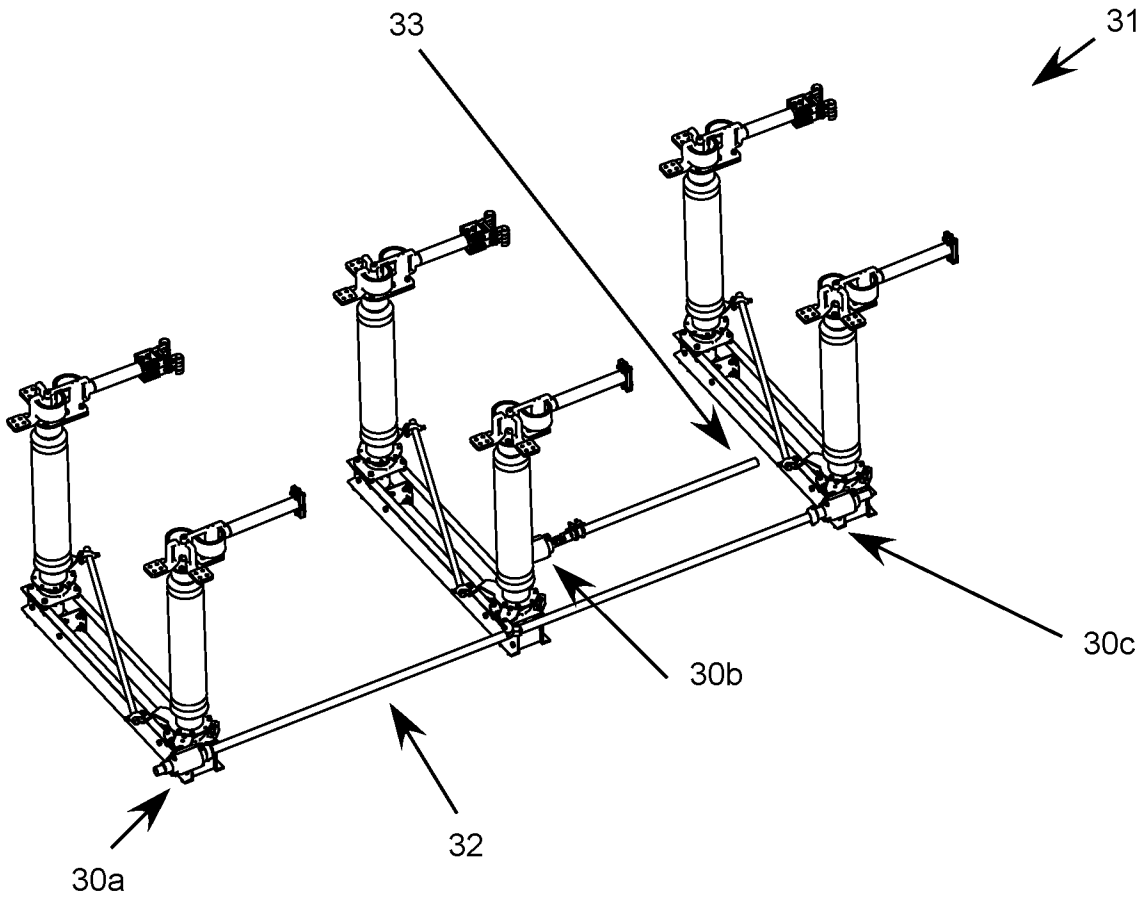
FIG. 3A is a perspective illustration of a three-phase disconnect switch including several quick-set clevis joints in the open position.
Figures 3B, 3C:
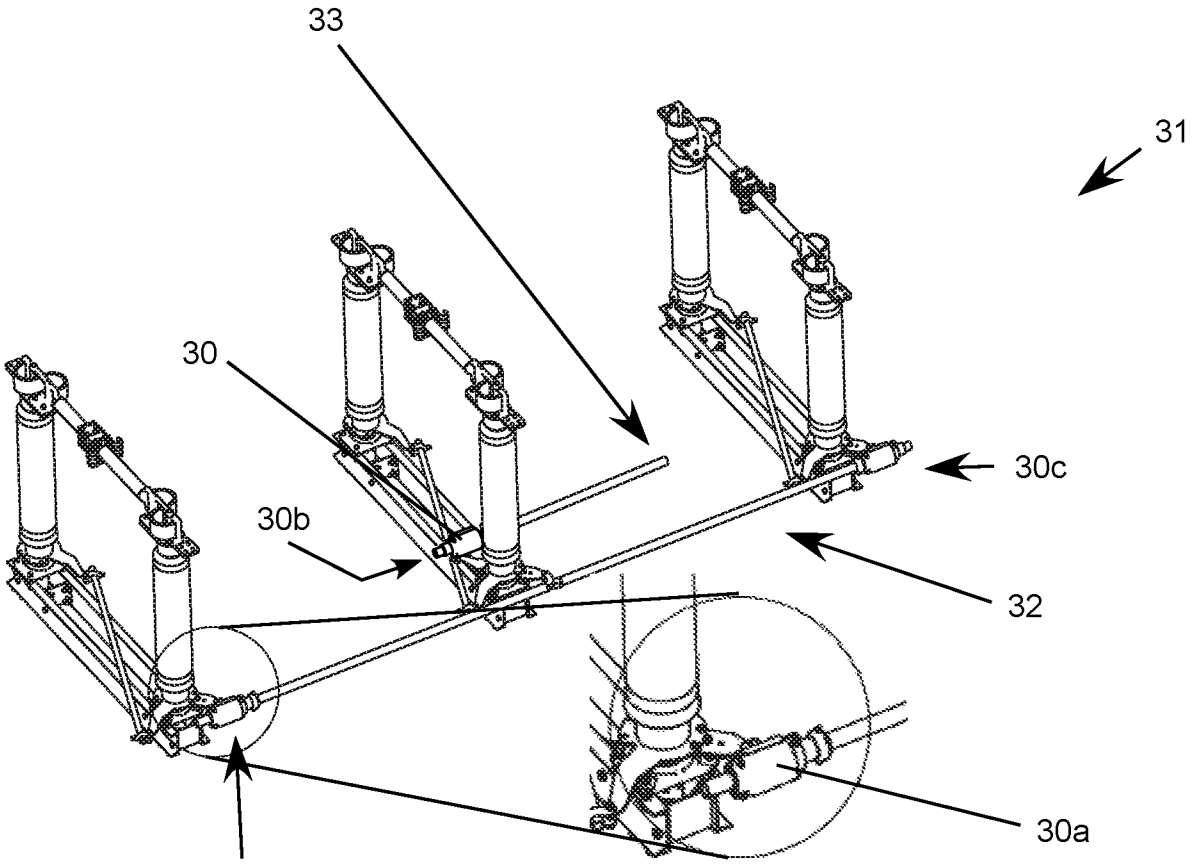
FIG. 3B is a perspective illustration of the three-phase disconnect switch including several quick-set clevis joints in the closed position.

FIGS. 3A and 3BG are conceptual perspective view of a three phase disconnect switch 31, which is similar to the conventional switch described with reference to FIGS. 1 and 2, except that the conventional clevis joints are replaced with quick-set clevis joints 30*a*-30*c* at three points in the linkage, one for each electric phase. FIG. 3A shows the three-phase disconnect switch 31 in the open position, while FIG. 3B shows the three-phase disconnect switch in the closed position. The first quick-set clevis joint 30*a* is located at the junction between the linkage pipe 32 and the operating lever for the Phase-A insulator, the second quick-set clevis joint 30*b* is located at the junction between the drive pipe 33 and the operating lever for the Phase-B insulator, and the third quick-set clevis joint 30*c* is located at the junction between the linkage pipe 32 and the operating lever for the Phase-C insulator.

FIG. 3A shows the three-phase disconnect switch 31 in the open position with the quick-set clevis joints 30*a*, 30*b* and 30*c* having rotated their associated insulators to their hard-stop, fully-open positions. FIG. 3B shows the three-phase disconnect switch 31 in the closed position with the quick-set clevis joints 30*a*, 30*b* and 30*c* having rotated their associated insulators to their hard-stop, fully-closed positions. While the fully-open positions are not critical, ensuring that the insulators of all three phases reach their hard-stop, fully-closed positions is critical to ensure proper seating of the switch blades in their respective jaws for proper switch operation. With a conventional linkage, calibrating the lengths of the linkage pipes to simultaneously move all three phases to their hard-stop, fully-closed positions can be very challenging.

As the quick-set clevis joints 30*a*, 30*b* and 30*c* are similar, the following description refers generally to a single quick-set clevis joint 30 as shown the remaining figures. The quick-set clevis joint 30 improves upon the conventional clevis joint by creating some "play" in the clevis joint between a linkage pipe and its associated operating lever. More specifically, the quick-set clevis joint 30 includes a spring-loaded sliding connection between the linkage pipe and its associated operating lever allowing the linkage pipe to slide axially within a connection range while remaining in operational contact with operating lever. This alleviates the need for precise calibration of the length of the linkage pipe required to move the operating lever to its hard-stop, fully-open or fully-closed positions. As a result, the technician only needs to adjust the length of the linkage pipe "close enough" to get it within the connection range of the quick-set clevis joint, and the "play" in the clevis joint afforded by the of the quick-set clevis joint "makes up the difference" required to move the operating lever all the way to its hard-stop, fully-open or fully-closed positions. In other words, the plunger action of the quick-set clevis joint 30 pushes the operating lever to its hard-stop position so long as the quick-set clevis joint is positioned within its connection range with the operating lever. This results in a tremendous advantage eliminating the need for precise calibration of the length of the linkage pipe when setting up the linkage.

Figure 4B:
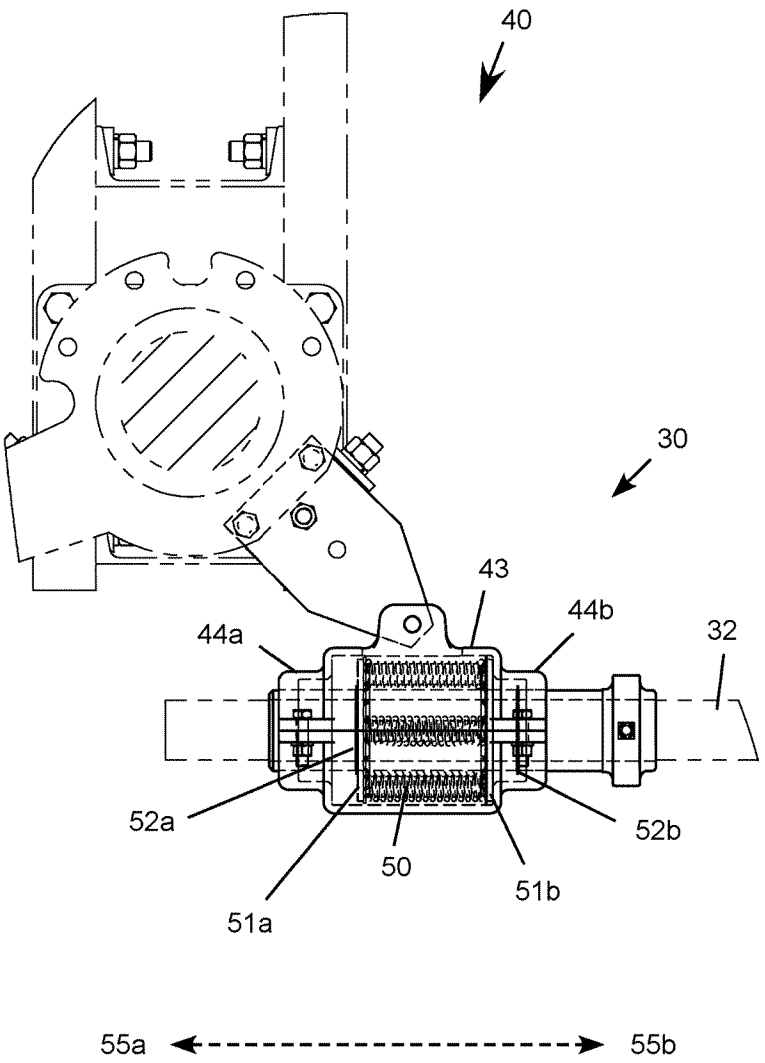
FIG. 4B is a top view of the insulator linkage with a cut-away top view of the quick-set clevis joint.
Figure 4A:
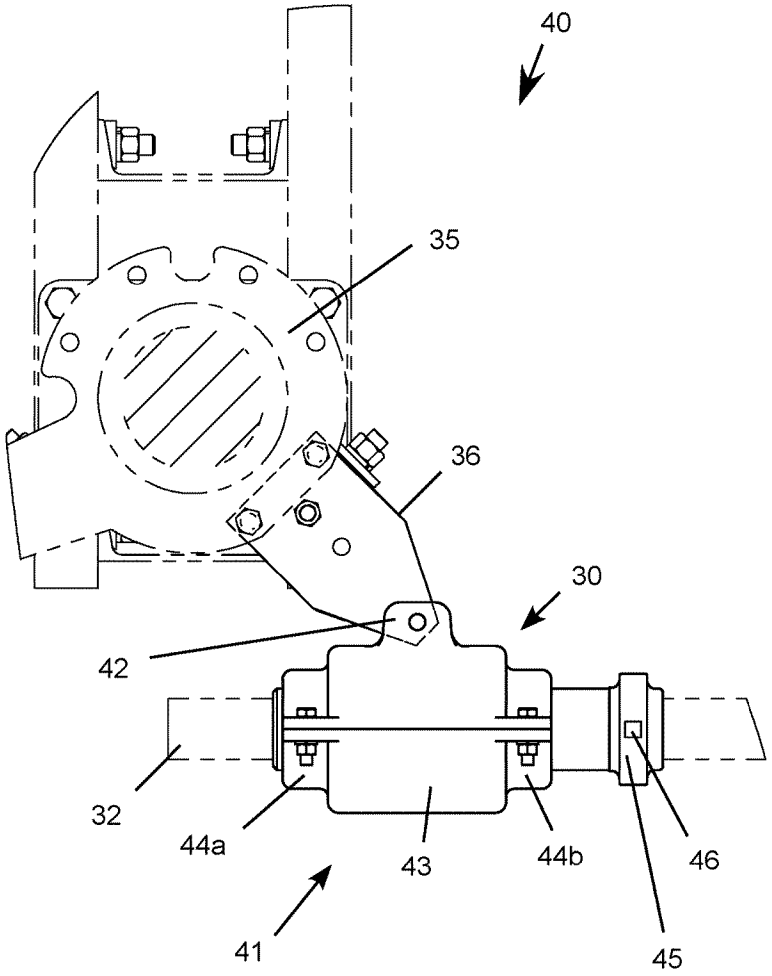
FIG. 4A is a top view of an insulator linkage including a top view of the quick-set clevis joint.

FIG. 4A is a conceptual top view of a representative insulator linkage 40 that includes a quick-set clevis joint 30 connecting a linkage pipe 32 to an operating lever 36, which is connected to an insulator flange 35 that rotates an associated insulator of a three-phase disconnect switch. The quick-set clevis joint 30 includes a clevis housing 41 defining a clevis bracket 42 for connecting the clevis housing to the operating lever 36. The clevis housing 41 also defines a spring chamber 43 axially aligned with a pair of channels 44*a* and 44*b*, one on each axial end of the spring chamber.

A support guide 45, which operates as a plunger with respect to the clevis housing 41, is partially received within the channel 44*b*. The linkage pipe 32 extends through the spring chamber 43, the channels 44*a* and 44*b*, and the support guide 45 with a self-piercing set screw 46 attaching the support guide to the linkage pipe. A second self-piercing set screw (shown in FIG. 5A) is located on the opposing side of the support guide 45. The quick-set clevis joint 30 allows the support guide 45, and thus linkage pipe 32, to operates as a plunger with respect to the clevis housing 41, within an axial connection range afforded by the spring-loaded action of the quick-set clevis joint.

Figure 5B:
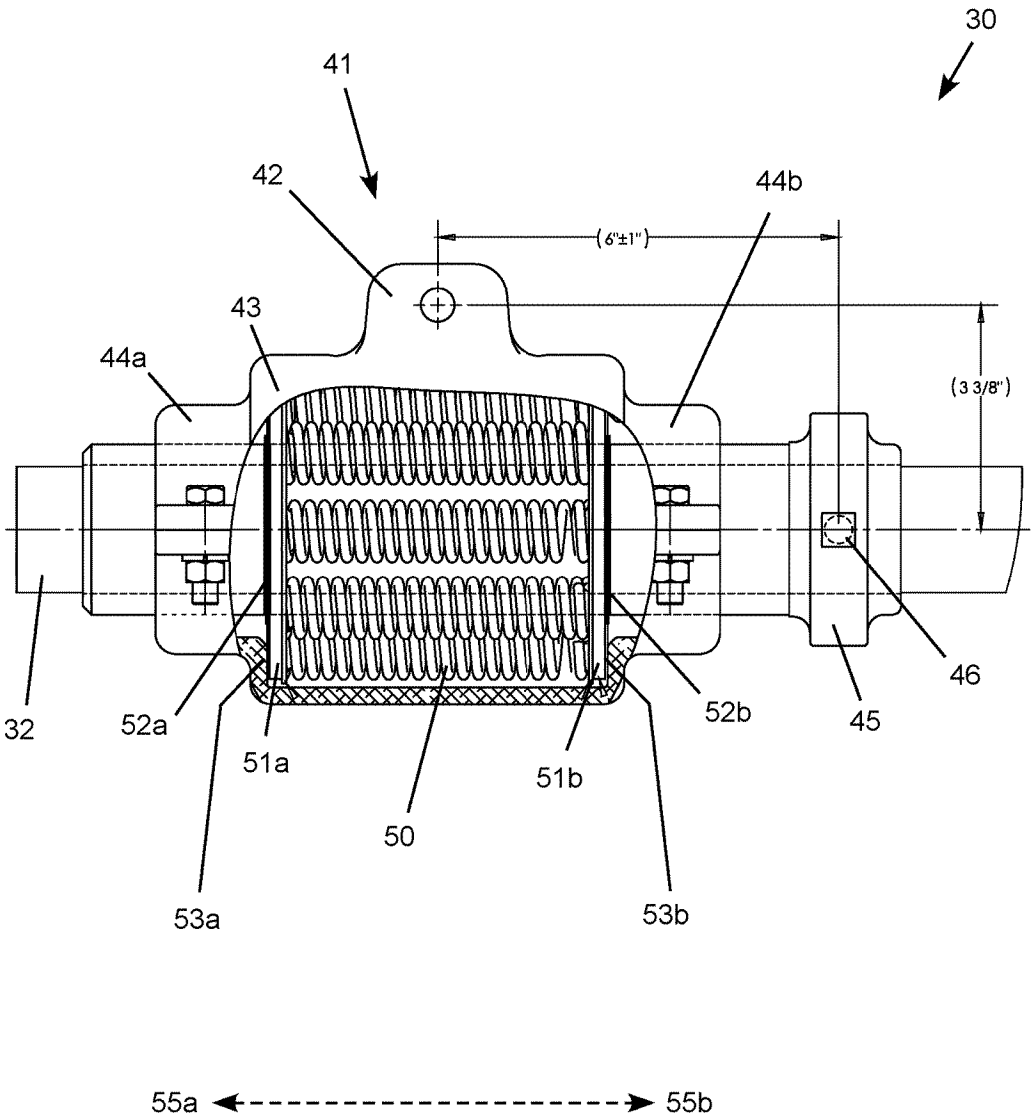
FIG. 5B is a cut-away top view of the quick-set clevis joint.
Figure 5A:
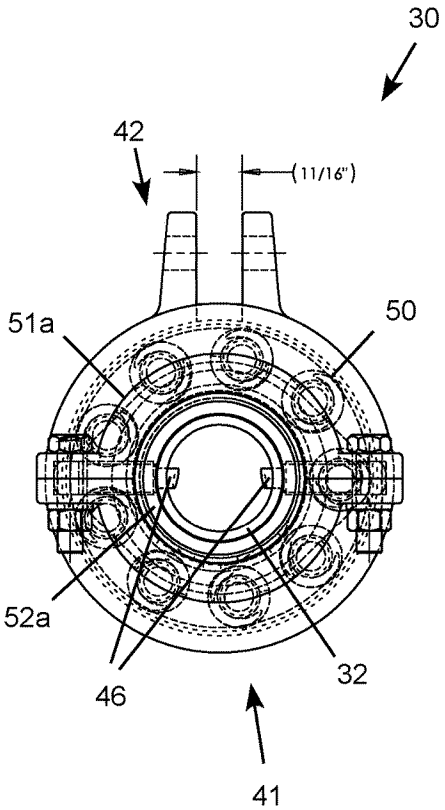
FIG. 5A is an end view of the quick-set clevis joint.

FIG. 4B is a cut-away view of FIG. 4A showing the internal features of the quick-set clevis joint 30, which allows the support guide 45 to remain captured on the linkage pipe 32, while also operating as a plunger with respect to the clevis housing 41. FIG. 5A shows an end view and FIG. 5B shows an enlarged side cut-away view of the quick-set clevis joint 30. The spring chamber 43 houses a number of springs spaced around the perimeter of the linkage pipe 32. Only one representative spring 50 is labeled to avoid cluttering the figure. The spring chamber 43 is bounded in a first axial direction 55*a* by a first spring chamber end wall 53*a* at a junction between the spring chamber and the first channel. Similarly, the spring chamber 43 is bounded in a second axial direction 55*b* by a second spring chamber end wall 53*b* at a junction between the spring chamber and the first channel The spring 50 is axially captured between a first thrust disk 51*a* and second thrust disk 51*b*, conceptually similar to conventional washers, which are also positioned around the linkage pipe 32. The thrust disks 51*a* and 51*b* are axially movable along the linkage pipe 32 and captured between a first retaining ring 52*a* and second retaining ring 52*b*. The thrust disks 51*a* and 51*b* are floating (i.e., axially movable) on the linkage pipe 32, while the retaining rings 52*a* and 52*b* are firmly attached to the linkage pipe. The first thrust disk 51*a* fits within the spring chamber 43 but is larger in diameter than the first channel 44*a*. This allows the first thrust disk 51*a* to travel axially within the spring chamber 43, while it is too large to enter the first channel 44*a*. The first retaining ring 52*a*, on the other hand, can travel axially within the spring chamber 43 as well the first channel 44*a*. In addition, the first retaining ring 52*a* is small enough to move axially within the first channel 44*a*, yet too large to move past the axial ends of the clevis housing 41, capturing the first retaining ring 52*a* within the clevis housing.

Similarly, the second thrust disk 51*b* fits within the spring chamber 43 but is larger in diameter than the second channel 44*b*. This allows the second thrust disk 51*b* to travel axially within the spring chamber 43, while it is too large to enter the second channel 44*b*. Thee retaining ring 52*b* can travel axially within the spring chamber 43 as well the second channel 44*b*. In addition, the second retaining ring 52*b* is small enough to move axially within the second channel 44*b*, yet too large to move past the axial ends of the clevis housing 41, capturing the second retaining ring 52*b* within the clevis housing. This configuration allows the support guide 45, and thus the linkage pipe 36, to remain captured on the linkage pipe 32, yet able to move axially with the linkage pipe like a plunger biased toward the center of the clevis housing 41 in both axial directions (to the left and right in FIG. 5B) by the spring 50 within an axial connection range with respect to the clevis housing 41. More specifically, the spring 50 is compressed between the thrust disks 51*a* and 51*b* with the first thrust disk 51*a* pushed against the first spring chamber end wall 53*a* when the linkage pipe 32 moves in the first axial direction 55*a* while the clevis housing 41 is blocked from moving in the first axial direction. This occurs when the operating lever 36 reaches its hard stop position in the clockwise direction with the linkage pipe 32 at its hard stop position in the first axial direction (to the left in FIG. 4B).

Similarly, the spring 50 is compressed between the thrust disks 51*a* and 51*b* with the second thrust disk 51*b* pushed against the second spring chamber end wall 53*b* when the linkage pipe 32 moves in the second axial direction 55*a* while the clevis housing 41 is blocked from moving in the second axial direction by a hard stop of the clevis housing. This occurs when the operating lever 36 reaches its hard stop position in the counter-clockwise direction with the linkage pipe 32 at its hard stop position in the first axial direction (to the right in FIG. 4B).

Figure 6A:
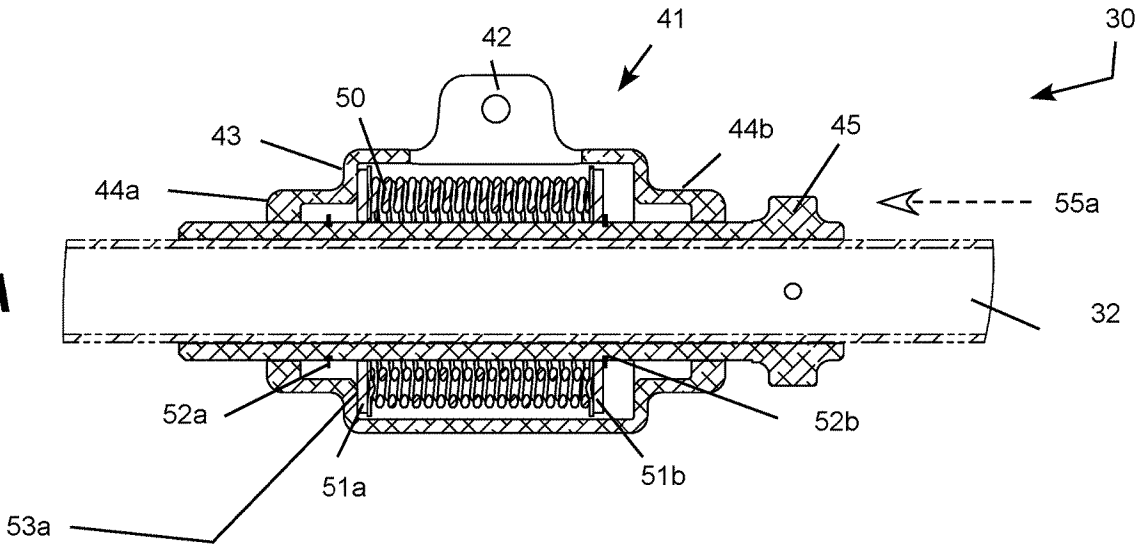
FIG. 6A is a cross-sectional top view of the quick-set clevis joint in a first configuration.
Figure 6B:
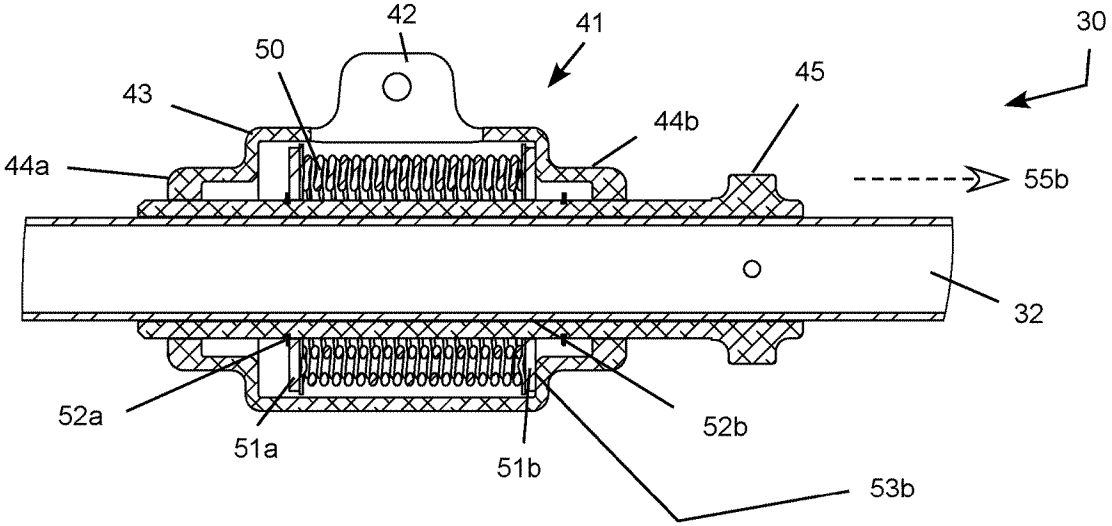
FIG. 6B is a cross-sectional top view of the quick-set clevis joint in a second configuration.

FIGS. 6A and 6B are cut-away side views of the quick-set clevis joint 30 showing the axial plunger movement of the support guide 45 with respect to the clevis housing 41. When the support guide 45 is moved in the first axial direction 55*a* (to the left in FIG. 6A), the second retaining ring 52*b* is pushed axially through the second channel 44*b* into the spring chamber 43, where the second retaining ring 52*b* engages with the second thrust disk 51*b* causing the spring 50 to compress in first axial direction 55*a* (to the left in FIG. 6A). This pushes the first thrust disk 55*a* against the first spring chamber end wall 53*a*. In this position, the spring 50 biases the support guide 45 back toward the center of the clevis housing 41 (to the right in FIG. 6A). The axial movement of the of the support guide 45 in the first axial direction 55*a* is ultimately limited by the axial length of the spring chamber 43, which houses the spring 50 captured within the spring chamber.

Similarly, when the support guide 45 is moved in the second axial direction 55*b* (to the right in FIG. 6B), the first retaining ring 52*a* is pushed axially through the first channel 44*a* into the spring chamber 43, where the first retaining ring 52*a* engages with the first thrust disk 51*a* causing the spring 50 to compress in the second axial direction 55*b* (to the right in FIG. 6B). This pushes the second thrust disk 55*b* against the second spring chamber end wall 53*b*. In this position, the spring 50 biases the support guide 45 back toward the center of the clevis housing 41 (to the left in FIG. 6A). Again, the axial movement of the of the support guide 45 in the second axial direction 55*b* is ultimately limited by the axial length of the spring chamber 43, which houses the spring 50 captured within the spring chamber. The connection range afforded by the quick-set clevis joint 30, providing the "play" in the clevis joint, is defined by the amount of axial movement of the support guide 45, from one axial limit to the other, with respect to the clevis housing 41.

The quick-set clevis joint linkage itself is not tied to any particular switch configuration and may be employed with any suitable three-phase linkage. In view of the foregoing, it will be appreciated that present invention provides significant improvements distribution automation system for high voltage electric power transmission and distribution systems. The foregoing relates only to the exemplary embodiments of the present invention, and numerous changes may be made therein without departing from the spirit and scope of the invention as defined by the following claims.

The invention claimed is:

1. A quick-set clevis joint for a three-phase electric disconnect switch linkage, comprising:

a clevis housing comprising a spring chamber axially aligned and disposed around a linkage pipe extending through the clevis housing;

a support guide disposed around the linkage pipe, secured to the linkage pipe, and extending through the clevis housing;

a spring positioned within the spring chamber allowing the support guide and linkage pipe to slide axially with respect to the clevis housing in first and second axial directions.

2. The quick-set clevis joint of claim 1, wherein:

the spring chamber bounded in the first axial direction by a first spring chamber end wall at a junction between the spring chamber and a first channel;

the spring chamber bounded in the second axial direction by a second spring chamber end wall at a junction between the spring chamber and a second channel.

3. The quick-set clevis joint of claim 2, further comprising:

a first retaining disk captured within the clevis housing, attached to the linkage pipe, sized and positioned to move in first and second axial directions within the first channel and the spring chamber;

a second retaining disk captured within the clevis housing, attached to the linkage pipe, sized and positioned to move in first and second axial directions within the second channel and the spring chamber.

4. The quick-set clevis joint of claim 3, further comprising:

a first thrust disk captured within the clevis housing, axially movable with respect to the linkage pipe, sized and positioned to move in the first and second axial directions within the spring chamber, while blocked from moving into the first channel by the first spring chamber end wall;

a second thrust disk captured within the clevis housing, axially movable with respect to the linkage pipe, sized and positioned to move in the first and second axial directions within the spring chamber, while blocked from moving into the second channel by the second spring chamber end wall.

5. The quick-set clevis joint of claim 4, wherein:

the first and second thrust disks is positioned to compress the spring with the first thrust disk pushed against the first spring chamber end wall when the linkage pipe moves in the first axial direction while the clevis housing is blocked from moving in the first axial direction;

the first and second thrust disks is positioned to compress the spring with the second thrust disk pushed against the second spring chamber end wall when the linkage pipe moves in the second axial direction while the clevis housing is blocked from moving in the first axial direction.

6. The quick-set clevis joint of claim 1, further comprising a clevis bracket formed by the clevis housing.

7. The quick-set clevis joint of claim 1, further comprising a self-piercing set screw attaching the support guide to the linkage pipe.

8. A quick-set clevis joint for a three-phase electric disconnect switch linkage, comprising:

a clevis housing comprising a spring chamber, a first channel, and a second channel axially aligned and disposed around a linkage pipe extending through the clevis housing;

a support guide disposed around the linkage pipe, secured to the linkage pipe, and extending through the clevis housing;

a spring positioned within the spring chamber allowing the support guide and linkage pipe to slide axially with respect to the clevis housing in first and second axial directions;

first and second thrust disks positioned to compress the spring with the first thrust disk pushed against a first spring chamber end wall when the linkage pipe moves in the first axial direction while the clevis housing is blocked from moving in the first axial direction;

the first and second thrust disks positioned to compress the spring with the second thrust disk pushed against a second spring chamber end wall when the linkage pipe moves in the second axial direction while the clevis housing is blocked from moving in the first axial direction.

9. The quick-set clevis joint of claim 8, further comprising a clevis bracket formed by the clevis housing.

10. The three-phase electric disconnect switch of claim 9, further comprising a self-piercing set screw attaching the support guide to the linkage pipe.

11. The three-phase electric disconnect switch of claim 8, wherein:

the spring chamber is bounded in the first axial direction by the first spring chamber end wall at a junction between the spring chamber and the first channel;

the spring chamber is bounded in the second axial direction by the second spring chamber end wall at a junction between the spring chamber and the second channel.

12. The three-phase electric disconnect switch of claim 11, further comprising:

a first retaining disk captured within the clevis housing, attached to the linkage pipe, sized and positioned to move in first and second axial directions within the first channel and the spring chamber;

a second retaining disk captured within the clevis housing, attached to the linkage pipe, sized and positioned to move in first and second axial directions within the second channel and the spring chamber.

13. The three-phase electric disconnect switch of claim 12, further comprising:

a first thrust disk captured within the clevis housing, axially movable with respect to the linkage pipe, sized and positioned to move in the first and second axial directions within the spring chamber, while blocked from moving into the first channel by the first spring chamber end wall;

a second thrust disk captured within the clevis housing, axially movable with respect to the linkage pipe, sized and positioned to move in the first and second axial directions within the spring chamber, while blocked from moving into the second channel by the second spring chamber end wall.

14. The three-phase electric disconnect switch of claim 13, wherein:

the first and second thrust disks is positioned to compress the spring with the first thrust disk pushed against the first spring chamber end wall when the linkage pipe moves in the first axial direction while the clevis housing is blocked from moving in the first axial direction;

the first and second thrust disks is positioned to compress the spring with the second thrust disk pushed against the second spring chamber end wall when the linkage pipe moves in the second axial direction while the clevis housing is blocked from moving in the first axial direction.

15. The three-phase electric disconnect switch of claim 14, further comprising a clevis bracket formed by the clevis housing.

16. A quick-set clevis joint for a three-phase electric disconnect switch linkage, comprising:

a clevis housing comprising a spring chamber, a first channel, and a second channel axially aligned and disposed around a linkage pipe extending through the clevis housing;

the spring chamber bounded in a first axial direction by a first spring chamber end wall at a junction between the spring chamber and the first channel;

the spring chamber bounded in a second axial direction by a second spring chamber end wall at a junction between the spring chamber and the second channel;

a support guide disposed around the linkage pipe, secured to the linkage pipe, and extending through the clevis housing;

a first retaining ring captured within the clevis housing, attached to the linkage pipe, sized and positioned to move in the first and second axial directions within the first channel and the spring chamber;

a second retaining ring captured within the clevis housing, attached to the linkage pipe, sized and positioned to move in the first and second axial directions within the second channel and the spring chamber;

a first thrust disk captured within the clevis housing, axially movable with respect to the linkage pipe, sized and positioned to move in the first and second axial directions within the spring chamber, while blocked from moving into the first channel by the first spring chamber end wall;

a second thrust disk captured within the clevis housing, axially movable with respect to the linkage pipe, sized and positioned to move in the first and second axial directions within the spring chamber, while blocked from moving into the second channel by the second spring chamber end wall;

a spring positioned within the spring chamber captured between the first and second thrust disks allowing the support guide and linkage pipe to slide axially with respect to the clevis housing in first and second axial directions;

the first and second thrust disks movable within the spring chamber to compress the spring in the first axial direction with the first thrust disk pushed against the first spring chamber end wall when the linkage pipe moves in the first axial direction while the clevis housing is blocked from moving in the first axial direction;

the first and second thrust disks movable within the spring chamber to compress the spring in the second axial direction with the second thrust disk pushed against the second spring chamber end wall when the linkage pipe moves in the second axial direction while the clevis housing is blocked from moving in the second axial direction.

* * * * *